US011289066B2

(12) United States Patent
Hisaminato et al.

(10) Patent No.: US 11,289,066 B2
(45) Date of Patent: Mar. 29, 2022

(54) VOICE SYNTHESIS APPARATUS AND VOICE SYNTHESIS METHOD UTILIZING DIPHONES OR TRIPHONES AND MACHINE LEARNING

(71) Applicant: YAMAHA CORPORATION, Hamamatsu (JP)

(72) Inventors: Yuji Hisaminato, Hamamatsu (JP); Ryunosuke Daido, Hamamatsu (JP); Keijiro Saino, Hamamatsu (JP); Jordi Bonada, Barcelona (ES); Merlijn Blaauw, Barcelona (ES)

(73) Assignee: YAMAHA CORPORATION, Hamamatsu (JP)

( * ) Notice: Subject to any disclaimer, the term of this patent is extended or adjusted under 35 U.S.C. 154(b) by 259 days.

(21) Appl. No.: 16/233,421

(22) Filed: Dec. 27, 2018

(65) Prior Publication Data

US 2019/0130893 A1 May 2, 2019

Related U.S. Application Data

(63) Continuation of application No. PCT/JP2017/023739, filed on Jun. 28, 2017.

(30) Foreign Application Priority Data

Jun. 30, 2016 (JP) ..... JP2016-129890

(51) Int. Cl.
*G10L 13/06* (2013.01)
*G10L 13/07* (2013.01)
(Continued)

(52) U.S. Cl.
CPC ..... *G10L 13/033* (2013.01); *G10L 13/06* (2013.01); *G10L 13/07* (2013.01); *G10L 13/08* (2013.01); *G10L 13/10* (2013.01); *G10L 25/18* (2013.01)

(58) Field of Classification Search
CPC ..... G10L 13/06; G10L 13/07
(Continued)

(56) References Cited

U.S. PATENT DOCUMENTS 7,454,343 B2 11/2008 Hirose et al.
7,643,990 B1 * 1/2010 Bellegarda ..... G10L 15/187 704/211
(Continued)

FOREIGN PATENT DOCUMENTS

JP 2002268660 A 9/2002
JP 3711880 B2 11/2005
(Continued)

OTHER PUBLICATIONS

International Search Report issued in Intl. Appln. No. PCT/JP2017/023739 dated Sep. 12, 2017. English translation provided.
(Continued)

*Primary Examiner* — Farzad Kazeminezhad
(74) *Attorney, Agent, or Firm* — Rossi, Kimms & McDowell LLP

(57) ABSTRACT

A voice synthesis method includes: sequentially acquiring voice units comprising at least one of diphone or a triphone in accordance with synthesis information for synthesizing voices; generating statistical spectral envelopes using a statistical model built by machine learning in accordance with the synthesis information for synthesizing the voices; and concatenating the sequentially acquired voice units and modifying a frequency spectral envelope of each voice unit in accordance with the generated statistical spectral envelope, thereby synthesizing a voice signal based on the concatenated voice units having the modified frequency spectra.

14 Claims, 4 Drawing Sheets

(51) Int. Cl.

| | |
|---|---|
| ***G10L 13/00*** | (2006.01) |
| ***G10L 13/033*** | (2013.01) |
| ***G10L 13/10*** | (2013.01) |
| ***G10L 13/08*** | (2013.01) |
| ***G10L 25/18*** | (2013.01) |

(58) Field of Classification Search
USPC ..... 704/207, 258
See application file for complete search history.

(56) References Cited

U.S. PATENT DOCUMENTS

| | | | | |
|---|---|---|---|---|
| 8,010,362 | B2 | 8/2011 | Tamura et al. | |
| 8,321,208 | B2 | 11/2012 | Tamura | |
| 2002/0184006 | A1 | 12/2002 | Yoshioka et al. | |
| 2003/0009336 | A1* | 1/2003 | Kenmochi | G10L 13/07 704/258 |
| 2003/0208355 | A1 | 11/2003 | Stylianou | |
| 2006/0173676 | A1* | 8/2006 | Kemmochi | G10L 13/06 704/207 |
| 2007/0083367 | A1* | 4/2007 | Baudino | G10L 19/0018 704/235 |
| 2016/0140951 | A1* | 5/2016 | Agiomyrgiannakis | G10L 13/02 704/260 |

FOREIGN PATENT DOCUMENTS

| | | | |
|---|---|---|---|
| JP | 2007226174 | A | 9/2007 |
| JP | 2007240564 | A | 9/2007 |
| JP | 2008203543 | A | 9/2008 |
| WO | 2006134736 | A1 | 12/2006 |

OTHER PUBLICATIONS

Written Opinion issued in Intl. Appln. No. PCT/JP2017/023739 dated Sep. 12, 2017.
Extended European Search Report issued in European Application No. 17820203.2 dated Jan. 28, 2020.

* cited by examiner

VOICE SYNTHESIS APPARATUS AND VOICE SYNTHESIS METHOD UTILIZING DIPHONES OR TRIPHONES AND MACHINE LEARNING

CROSS-REFERENCE TO RELATED APPLICATIONS

This application is a Continuation Application of PCT Application No. PCT/JP2017/023739, filed Jun. 28, 2017, and is based on and claims priority from Japanese Patent Application No. 2016-129890, filed Jun. 30, 2016. The entire contents of the above applications are incorporated herein by reference.

BACKGROUND

The present disclosure relates to a technology for synthesizing a voice.

DESCRIPTION OF THE RELATED ART

Conventionally, there has been proposed a voice synthesis technology that synthesizes a voice of freely chosen phonemes (spoken content). For example, Japanese Patent Application Laid-Open Publication No. 2007-240564 (hereafter referred to as Patent Document 1) discloses a unit-concatenating-type voice synthesis in which some voice units are selected from among voice units in accordance with a target phoneme, and concatenated to generate a synthesis voice. Further, Japanese Patent Application Laid-Open Publication No. 2002-268660 discloses a statistical-model-type voice synthesis in which a series of spectral parameters expressing vocal tract characteristics are generated by HMM (Hidden Markov Model) and then an excitation signal is processed by a synthesis filter having frequency characteristics corresponding to the spectral parameters to generate a synthesis voice.

There is a demand for synthesizing voices of a variety of features, such as a strongly uttered voice and a gently uttered voice, in addition to a voice of a neutral feature. To synthesize voices of a variety of features by unit-concatenating-type voice synthesis, a set of voice units (a voice synthesis library) must be prepared for each of the voice features. Accordingly, a large amount of storage capacity is required to store such voice units. A spectrum estimated by a statistical model in the statistical-model-type voice synthesis is a spectrum obtained by averaging many spectra in a learning process, and therefore has a lower time resolution and a lower frequency resolution compared to those of voice units for the unit-concatenating-type voice synthesis. Accordingly, it is difficult to generate a high-quality synthesis voice.

SUMMARY

In view of the circumstances, it is an object of the present invention to generate a high-quality synthesis voice of a desired voice feature, while a storage capacity required for synthesizing the voice is moderated.

A voice synthesis method in accordance with some embodiments includes: sequentially acquiring voice units in accordance with synthesis information for synthesizing voices; generating a statistical spectral envelope using a statistical model, the statistical spectral envelope being in accordance with the synthesis information; and concatenating the acquired voice units and modifying a frequency spectral envelope of each of the acquired voice units in accordance with the generated statistical spectral envelope, thereby synthesizing a voice signal based on the concatenated voice units having the modified frequency spectra.

A voice synthesis apparatus in accordance with some embodiments includes: a unit acquirer configured to sequentially acquire voice units in accordance with synthesis information for synthesizing voices; an envelope generator configured to generate a statistical spectral envelope using a statistical model, the statistical spectral envelope being in accordance with the synthesis information; and a voice synthesizer configured to concatenate the acquired voice units and modify a frequency spectral envelope of each of the acquired voice units in accordance with the generated statistical spectral envelope, thereby synthesizing a voice signal based on the concatenated voice units having the modified frequency spectra.

DETAILED DESCRIPTION OF THE EMBODIMENTS

Selected embodiments will now be explained with reference to the drawings. It will be apparent to those skilled in the field of voice synthesis from this disclosure that the following descriptions of the embodiments are provided for illustration only and not for the purpose of limiting the invention as defined by the appended claims and their equivalents.

First Embodiment

Figure 1:
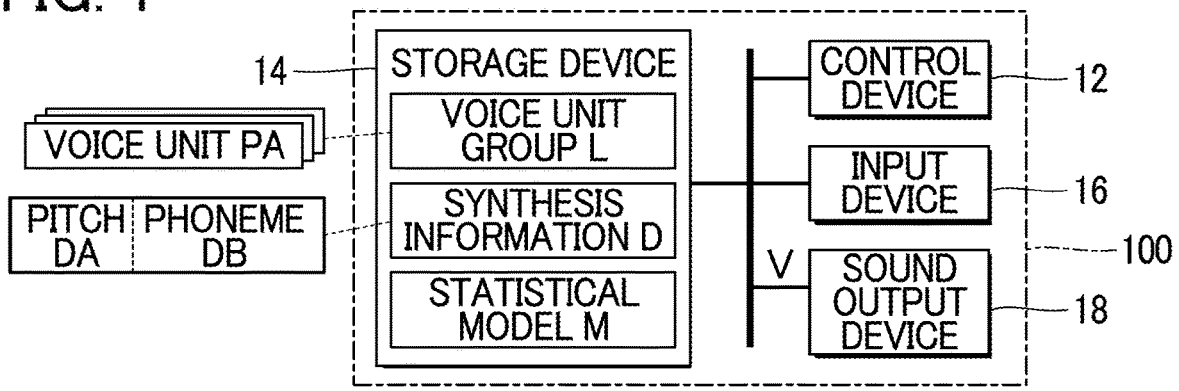
FIG. 1 is a block diagram of a voice synthesis apparatus according to a first embodiment.

FIG. 1 is a block diagram of a voice synthesis apparatus 100 according to a first embodiment. The voice synthesis apparatus 100 of the first embodiment is a signal processing apparatus that synthesizes a voice consisting of desired phonemes (spoken content). The voice synthesis apparatus 100 is realized by a computer system that includes a control device 12, a storage device 14, an input device 16, and a sound output device 18. For example, a portable terminal device, such as a mobile phone or a smartphone, or a portable or stationary terminal device, such as a personal computer, may be used as the voice synthesis apparatus 100. The voice synthesis apparatus 100 of the first embodiment generates an audio signal V of a voice by which a specific piece of music (hereafter referred to as "music piece A") is sung. The voice synthesis apparatus 100 may be realized by a single apparatus, or may be realized by a set of devices separate from each other (i.e., a computer system).

The control device 12 may include one or more processors, such as a CPU (Central Processing Unit), and is configured to centrally control each element of the voice synthesis apparatus 100. The input device 16 is a user interface configured to receive instructions from a user. For example, an operation element that a user can operate, or a touch panel, which detects a touch operation by the user on the screen (illustration omitted), may be the input device 16. The sound output device 18 (e.g., loudspeaker or headphones) outputs a sound corresponding to the audio signal V generated by the voice synthesis apparatus 100. For brevity, illustration of a D/A converter that converts an audio signal V from a digital signal to an analog signal is omitted.

The storage device 14 stores a program executed by the control device 12, and various data used by the control device 12. For example, a publicly known recording medium, such as a semiconductor recording medium or a magnetic recording medium, or a combination of different types of recording media may be used as the storage device 14 as desired. The storage device 14 (e.g., cloud storage) may be provided separately from the voice synthesis apparatus 100, and the control device 12 may read data out from or writes data into the storage device 14 via a mobile communication network or a communication network such as the Internet. The storage device 14 may be omitted from the voice synthesis apparatus 100.

As shown in FIG. 1, the storage device 14 in the first embodiment stores a voice unit group L, synthesis information D, and a statistical model M. The voice unit group L is a set of unit data (voice synthesis library) indicative of each of voice units PA that are samples extracted in advance from recorded voices uttered by a specific speaker (hereafter referred to as "speaker B"). The voice units PA in the first embodiment are extracted from recorded voices, uttered by the speaker B, of a neutral voice feature (hereafter referred to as "first voice feature"). Each voice unit PA represents, for example, a single phoneme, such as a vowel or a consonant, or a sequence of phonemes (e.g., a diphone or a triphone). The voice units PA of a sufficiently high time resolution and/or a sufficiently high frequency resolution are recorded in the voice unit group L.

Figure 2:
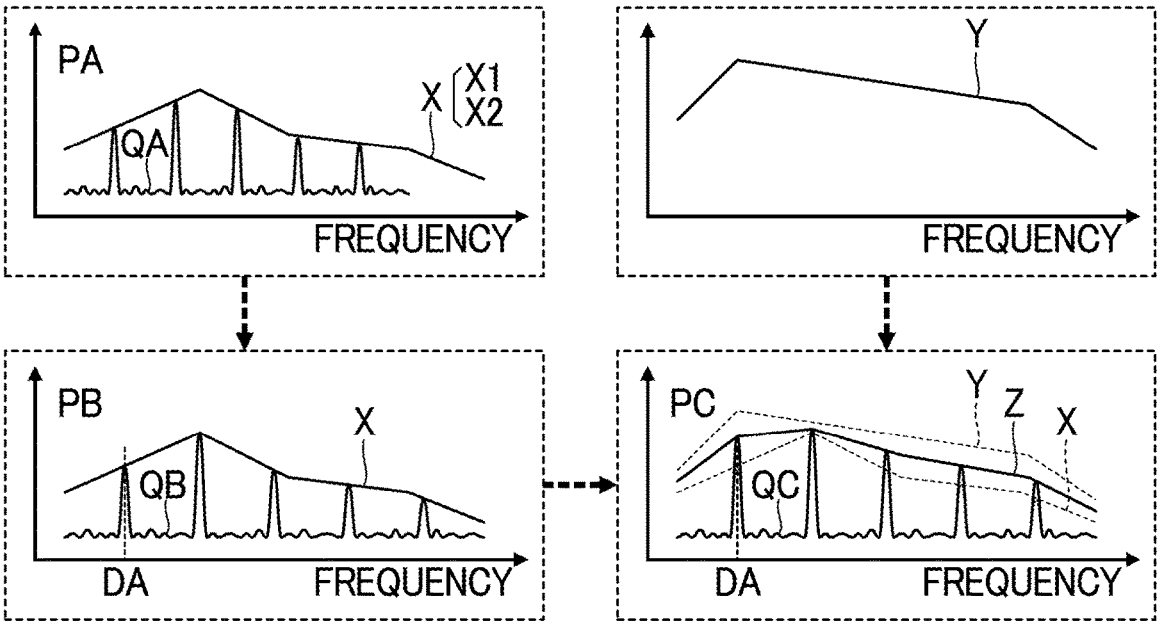
FIG. 2 is an explanatory view of the manner of operation of the voice synthesis apparatus.

As shown in FIG. 2, unit data of each voice unit PA specify a frequency spectrum QA and a spectral envelope (hereafter referred to as "unit spectral envelope") X for each of unit periods (frames) that are divided periods of the voice unit PA along a time axis. A frequency spectrum QA of each frame is a complex spectrum (or an expression in polar form) of the voice unit PA, for example. A unit spectral envelope X is an envelope expressing an outline of the corresponding frequency spectrum QA. Since the unit spectral envelope X of a frame can be calculated from the frequency spectrum QA of the frame, unit spectral envelopes X may not be included in the unit data. However, it is cumbersome to uniquely calculate a preferable unit spectral envelope X from a frequency spectrum QA. Accordingly, in an actual situation, it is preferable that the unit data specify a unit spectral envelope X in addition to a frequency spectrum QA.

The unit spectral envelope X may contain a smoothed component X1 that shows slow fluctuation on the time axis and/or coarse variation on the frequency axis, and a fluctuation component X2 that shows faster fluctuation on the time axis and finer variation on the frequency axis compared to the smoothed component X1. In this embodiment, the smoothed component X1 can be obtained as follows. At first, the frequency spectrum QA is smoothed by a predetermined degree of smoothness in a frequency-axis direction so as to obtain a spectral envelope X0. Then, the spectral envelope X0 is smoothed by a higher degree of smoothness in the frequency-axis direction than the predetermined degree, or smoothed by a predetermined degree of smoothness in the time-axis direction, or smoothed in both ways to obtain the smoothed component X1. The fluctuation component X2 is obtained by subtracting the smoothed component X1 from the spectral envelope X0. The smoothed component X1 and the fluctuation component X2 may be expressed as any kind of feature amount, such as, for example, line spectral pair coefficients or an amplitude value for each frequency. More specifically, for example, the smoothed component X1 is preferably expressed by line spectral pair coefficients, while the fluctuation component X2 is preferably expressed by an amplitude value for each frequency.

The synthesis information D in FIG. 1 is data by which the content of synthesis to be performed by the voice synthesis apparatus 100 is instructed (instructions for synthesizing voices). More specifically, the synthesis information D specifies a pitch DA and one or more phonemes DB for each of the musical notes that constitute the music piece A. The pitch DA is denoted by a note number of MIDI (Musical Instrument Digital Interface), for example. The phonemes DB are the spoken content uttered by a synthesis voice (i.e., lyrics in the music piece A), and each phoneme DB is denoted by a grapheme or a phonetic symbol, for example. The synthesis information D is generated and modified in accordance with instructions input by a user at the input device 16. The synthesis information D may be distributed from a distribution server device via a communication network and stored in the storage device 14.

The statistical model M is a mathematical model for statistically estimating, in accordance with the synthesis information D, a temporal change of a spectral envelope (hereafter referred to as "statistical spectral envelope") Y of a voice of a voice feature different from the voice feature of the voice units PA. The statistical model M in the first embodiment may be a context-dependent model that includes transition models each of which is specified by an attribute (context) to be identified in the synthesis information D. The attribute to be identified corresponds to, for example, any one, two, or all of pitch, volume, and phoneme. Each of the transition models is a HMM (Hidden Markov Model) described for multiple states. For each of the states of the transition model, statistical values (for example, a mean vector and a covariance matrix) that define occurrence probability distribution of the statistical spectral envelope Y are set in advance. The statistical values may define temporal transition between the states. The statistical values for each of the states of each transition model are stored in the storage device 14 as the statistical model M. The attributes to specify the transition models may include, in addition to information (pitch, volume, phoneme, and the like) related to a phoneme at each point in time, information related to a phoneme immediately before or after the phoneme at each point in time.

The statistical model M is built in advance by machine learning in which spectral envelopes of many voices of a certain feature uttered by the speaker B are used as training data. For example, from among transition models included in the statistical model M of a certain voice feature, a transition model corresponding to any one attribute is built by machine learning in which spectral envelopes of one or more voices classified into that attribute from among the many voices, uttered by the speaker B, of the certain voice feature are used as training data. Here, the voice to be used as training data in machine learning for the statistical model M is a voice, uttered by the speaker B, of a voice feature (hereafter referred to as "second voice feature") different from the first voice feature of the voice units PA. More specifically, any of the voices of the second voice features stated below, uttered by the speaker B, may be used as the training data in the machine learning to build the statistical model M: a voice uttered more forcefully, a voice uttered more gently, a voice uttered more vigorously, or a voice uttered less clearly, than the voice of the first voice feature. That is, statistical tendencies of spectral envelopes of voices uttered with any second voice feature are modeled in a statistical model M as statistical values for each of attributes. Accordingly, by using this statistical model, a statistical spectral envelope Y of a voice of the second voice feature can be estimated. The data amount of the statistical model M is sufficiently small compared to that of the voice unit group L. The statistical model M may be provided separately from the voice unit group L as additional data for the voice unit group L of the neutral first voice feature.

Figure 3:
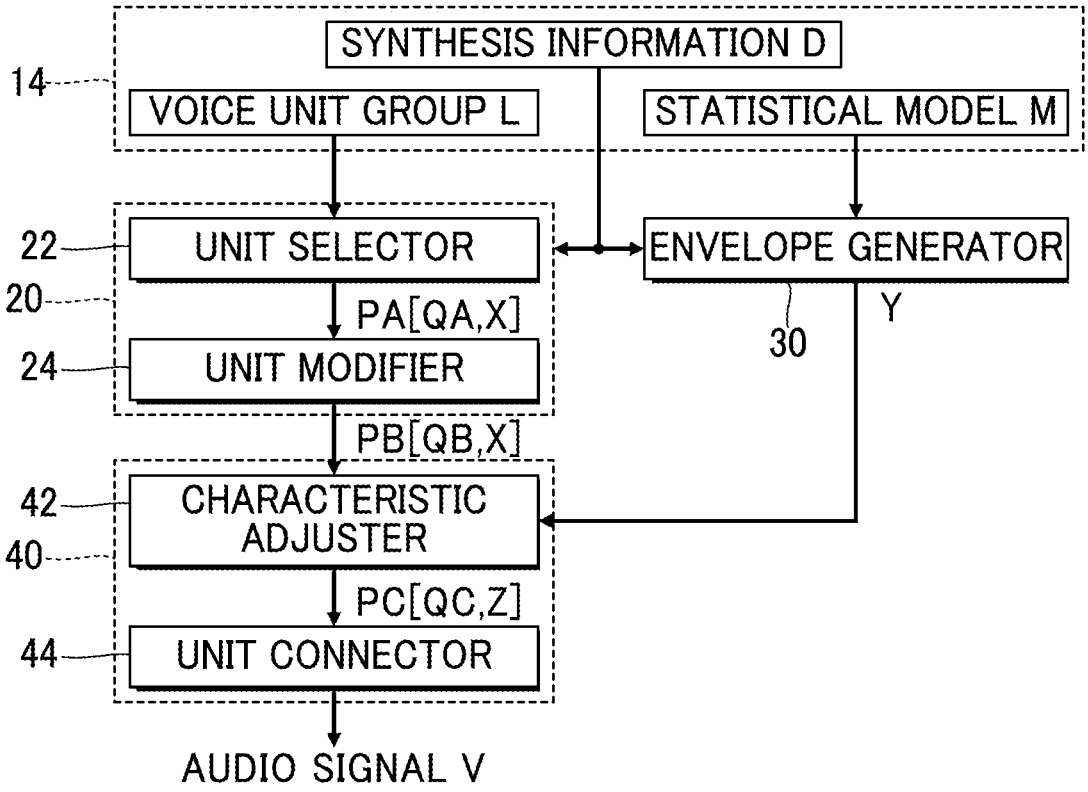
FIG. 3 is a functional block diagram of the voice synthesis apparatus.

FIG. 3 is a block diagram focusing on functions of the control device 12 in the first embodiment. As shown in FIG. 3, the control device 12 executes the program stored in the storage device 14 so as to realize functions (a unit acquirer 20, an envelope generator 30, and a voice synthesizer 40) for generating an audio signal V of a synthesis voice in accordance with the synthesis information D. Alternatively, the functions of the control device 12 may be realized by multiple devices, or any part of the functions of the control device 12 may be realized by a dedicated electronic circuit.

The unit acquirer 20 sequentially acquires voice units PB in accordance with the synthesis information D. More specifically, the unit acquirer 20 obtains a voice unit PB by adjusting a voice unit PA that corresponds to a phoneme DB specified by the synthesis information D to have a pitch DA specified by the synthesis information D. As shown in FIG. 3, the unit acquirer 20 in the first embodiment includes a unit selector 22 and a unit modifier 24.

The unit selector 22 sequentially selects voice units PA from the voice unit group L in the storage device 14, each of the voice units PA corresponding to each of phonemes DB specified, by the synthesis information D, for each musical note. Voice units PA of different pitches may be recorded in the voice unit group L. The unit selector 22 selects a voice unit PA of a pitch close to the pitch DA specified by the synthesis information D, from among the voice units PA of various pitches and correspond to the phoneme DB specified by the synthesis information D.

The unit modifier 24 adjusts the pitch of the voice unit PA selected by the unit selector 22 to the pitch DA specified by the synthesis information D. For adjustment of the pitch of the voice unit PA, the technology described in Patent Document 1 may, for example, preferably be used. More specifically, as shown in FIG. 2, the unit modifier 24 adjusts the pitch of the voice unit PA to the pitch DA by extending or contracting the frequency spectrum QA of the voice unit PA in a frequency-axis direction, and adjusts the intensity such that the peaks of the adjusted frequency spectrum are positioned on the line of the unit spectral envelope X, thereby generating a frequency spectrum QB. Accordingly, the voice unit PB acquired by the unit acquirer 20 is expressed by the frequency spectrum QB and the unit spectral envelope X. The contents of the processing performed by the unit modifier 24 are not limited to the adjustment of the pitch of the voice unit PA. For example, the unit modifier 24 may perform interpolation between voice units PA adjacent to each other.

The envelope generator 30 shown in FIG. 3 generates a statistical spectral envelope Y in accordance with the synthesis information D by using the statistical model M. More specifically, the envelope generator 30 sequentially retrieves transition models of attributes (context) in accordance with the synthesis information D from the statistical model M, and concatenates the retrieved models with each other, and then, sequentially generates statistical spectral envelopes Y, namely each spectral envelope for each unit period, using a temporal series of the concatenated transition models. In other words, spectral envelopes of voices of the second voice feature, the voices resulting from uttering phonemes DB specified by the synthesis information D, are sequentially generated by the envelope generator 30 as statistical spectral envelopes Y.

The statistical spectral envelope Y may be expressed as any of various kinds of feature amounts, such as line spectral pair coefficients or low-order cepstral coefficients. "Low-order cepstral coefficients" refer to a predetermined number of coefficients on the low order side that result from resonance characteristics of an articulatory organ, such as a vocal tract, from among cepstral coefficients derived by a Fourier transformation of the logarithm of the power spectrum of a signal. When a statistical spectral envelope Y is expressed by line spectral pair coefficients, the coefficient values need to regularly increase from a low order side to a high order side of the coefficients. However, in a process of generating a statistical spectral envelope Y by the statistical model M, the above-mentioned regularity may break down (the statistical spectral envelope Y may not be properly expressed) due to some statistical calculations, such as averaging of the line spectral pair coefficients. Accordingly, as feature amounts for expressing a statistical spectral envelope Y, low-order cepstral coefficients are more preferably used than line spectral pair coefficients.

The voice synthesizer 40 shown in FIG. 3 generates an audio signal V of a synthesis voice based on the voice units PB acquired by the unit acquirer 20, and the statistical spectral envelopes Y generated by the envelope generator 30. More specifically, the voice synthesizer 40 generates an audio signal V indicative of a synthesis voice derived by concatenating the voice units PB and adjusting the voice units PB in accordance with the statistical spectral envelopes Y. As shown in FIG. 3, the voice synthesizer 40 in the first embodiment includes a characteristic adjuster 42 and a unit connector 44.

The characteristic adjuster 42 adjusts the frequency spectrum QB of each voice unit PB acquired by the unit acquirer 20 such that the envelope (unit spectral envelope X) of the frequency spectrum QB approximates the statistical spectral envelope Y generated by the envelope generator 30, thereby generating a frequency spectrum QC of a voice unit PC. The unit connector 44 concatenates voice units PC adjusted by the characteristic adjuster 42 to generate an audio signal V. More specifically, the characteristic adjuster 42 transforms a frequency spectrum QC of each frame in the voice units PC into a waveform signal in the time domain (a signal multiplied by a window function in a time-axis direction) by a calculation, such as a short-time inverse Fourier transform, for example. Then, the unit connector 44 aligns waveform signals of a series of frames such that the rear section of a waveform signal of a preceding frame and the front section of a waveform signal of a succeeding frame overlap with each other on time axis, and adds the aligned waveforms each other. Using such an operation, an audio signal V that corresponds to a series of frames is generated. For the transformation, a phase spectrum of a voice unit PA (if recorded) may be used as a phase spectrum of a voice unit PC, or a phase spectrum may be calculated under a minimum phase condition from the frequency spectrum QC as the phase spectrum of the voice unit PC.

Figure 4:
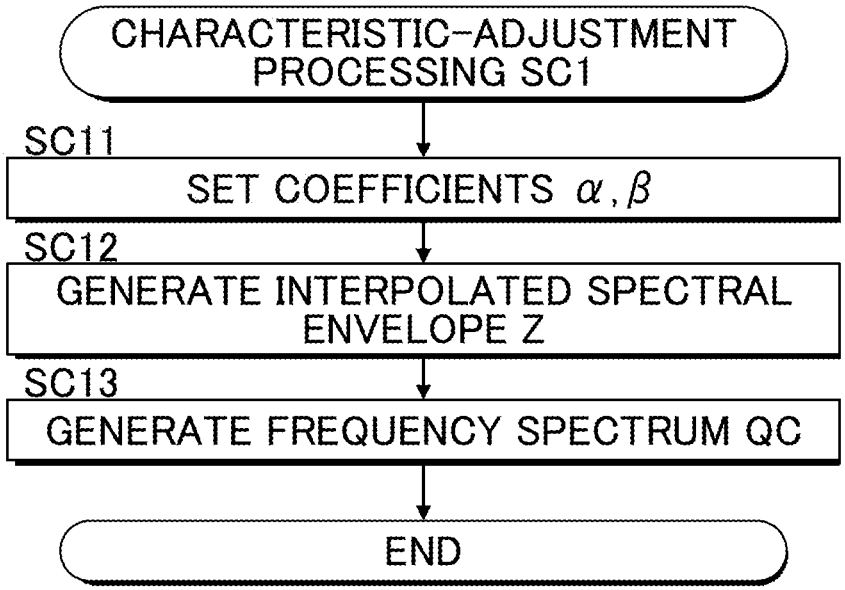
FIG. 4 is a flowchart showing characteristic-adjustment processing.

FIG. 4 is a flowchart showing processing (hereafter referred to as "characteristic-adjustment processing") SC1 where the characteristic adjuster 42 (the control device 12) obtains a frequency spectrum QC of a voice unit PC from a frequency spectrum QB of a voice unit PB. As shown in FIG. 4, the characteristic adjuster 42 sets a coefficient α and a coefficient β (SC11). Each of the coefficient (an example of an interpolation coefficient) α and the coefficient β is a non-negative value equal to or less than one ($0 \leq \alpha \leq 1$, $0 \leq \beta \leq 1$) and set according to one or more instructions input to the input device 16 by a user, for example.

The characteristic adjuster 42 interpolates, in accordance with the coefficient α, between the unit spectral envelope X of a voice unit PB acquired by the unit acquirer 20 and the statistical spectral envelope Y generated by the envelope generator 30, thereby generating a spectral envelope (hereafter referred to as "interpolated spectral envelope") Z (SC12). As shown in FIG. 2, the interpolated spectral envelope Z is a spectral envelope having characteristics intermediate between the unit spectral envelope X and the statistical spectral envelope Y. More specifically, the interpolated spectral envelope Z is expressed by the following equation (1) and equation (2).

$$Z=F(C) \tag{1}$$

$$C=\alpha \cdot cY+(1-\alpha) \cdot cX1+\beta \cdot cX2 \tag{2}$$

Symbol cX1 in equation (2) denotes a feature amount indicating a smoothed component X1 of the unit spectral envelope X. Symbol cX2 denotes a feature amount indicating a fluctuation component X2 of the unit spectral envelope X. Symbol cY denotes a feature amount indicating the statistical spectral envelope Y. In equation (2), a case is assumed where the feature amount cX1 and the feature amount cY are the same kind of feature amount (e.g., line spectral pair coefficients). Symbol F(C) in equation (1) denotes a transformation function that transforms the feature amount C calculated by equation (2) into a spectral envelope (i.e., a series of numerical values for a series of frequencies).

As will be understood from equation (1) and equation (2), the characteristic adjuster 42 calculates the interpolated spectral envelope Z by weighting, in accordance with the coefficient β, the fluctuation component X2 of the unit spectral envelope X, and adding the weighted component to an interpolated value ($\alpha \cdot cY+(1-\alpha) \cdot cX1$) between the statistical spectral envelope Y and the smoothed component X1 of the unit spectral envelope X. As will be understood from equation (2), as the coefficient α increases, the interpolated spectral envelope Z becomes closer to the statistical spectral envelope Y; and as the coefficient α decreases, the interpolated spectral envelope Z becomes closer to the unit spectral envelope X. In other words, as the coefficient α increases (as the coefficient α approaches the maximum value one), the audio signal V of the synthesis voice becomes closer to the second voice feature. As the coefficient α decreases (as the coefficient α approaches the minimum value zero), the audio signal V of the synthesis voice becomes closer to the first voice feature. Further, when the coefficient α is set to the maximum value one ($C=cY+\beta \cdot cX2$), the audio signal V of the synthesis voice represents the voice of the second feature, resulting from uttering, with the second voice feature, phonemes DB specified by the synthesis information D. On the other hand, when the coefficient α is set to the minimum value zero ($C=cY+\beta \cdot cX2$), the audio signal V of the synthesis voice represents the voice of the first voice feature, resulting from uttering, with the first voice feature, phonemes DB specified by the synthesis information D. As will be understood from the above description, the interpolated spectral envelope Z is obtained from the unit spectral envelope X and the statistical spectral envelope Y; and the interpolated spectral envelope Z may be regarded as having one of the first voice feature and the second voice feature modified to approximate the other of the first voice feature and the second voice feature. That is, the interpolated spectral envelope Z corresponds to a spectral envelope obtained by causing one of the unit spectral envelope X or the statistical spectral envelope Y to approximate the other of the unit spectral envelope X or the statistical spectral envelope Y. In other words, the interpolated spectral envelope Z is a spectral envelope having characteristics of both the unit spectral envelope X and the statistical spectral envelope Y, or a spectral envelope in which characteristics of the unit spectral envelope X and the statistical spectral envelope Y are combined.

As described above, the smoothed component X1 of the unit spectral envelope X and the statistical spectral envelope Y may be expressed as different kinds of feature amounts. For example, a case may be envisaged where the feature amounts cX1, which indicate the smoothed component X1 of the unit spectral envelope X, are line spectral pair coefficients, and the feature amounts cY, which indicate the statistical spectral envelope Y, are low-order cepstral coefficients. In such a case, the above-mentioned equation (2) can be replaced with the following equation (2a).

$$C=\alpha \cdot G(cY)+(1-\alpha) \cdot X1+\beta \cdot cX2 \tag{2a}$$

Symbol G(cY) in equation (2a) denotes a transformation function for transforming the feature amounts cY, which are low-order cepstral coefficients, to line spectral pair coefficients of the same kind as the feature amounts cX1.

The characteristic adjuster 42 adjusts the frequency spectra QB of the voice units PB acquired by the unit acquirer 20 to approximate the interpolated spectral envelopes Z obtained through the above steps (SC11 and SC12), thereby generating frequency spectra QC of the voice units PC (SC13). More specifically, as shown in FIG. 2, the characteristic adjuster 42 obtains a frequency spectrum QC by adjusting the intensity of the corresponding frequency spectrum QB such that each peak of the frequency spectrum QB is positioned on the line of the interpolated spectral envelope Z. An example of the processing of the characteristic adjuster 42 is as described above.

Figure 5:
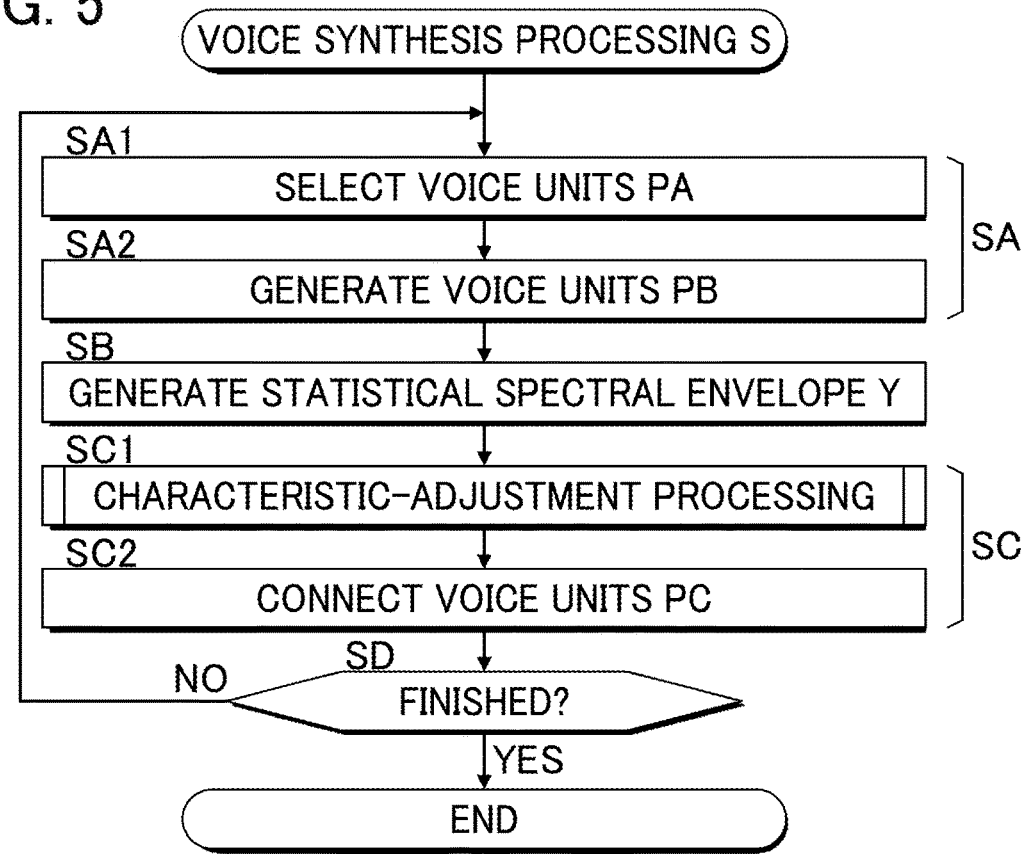
FIG. 5 is a flowchart showing voice synthesis processing.

FIG. 5 is a flowchart showing processing (hereafter referred to as "voice synthesis processing") S for generating an audio signal V of a synthesis voice in accordance with the synthesis information D. The voice synthesis processing S shown in FIG. 5 starts when an instruction to start voice synthesis is input by a user via an operation at the input device 16.

After the voice synthesis processing S by the control device 12 starts, the unit acquirer 20 sequentially acquires voice units PB in accordance with the synthesis information D (SA). More specifically, the unit selector 22 selects a voice unit PA that corresponds to a phoneme DB specified by the synthesis information D from the voice unit group L (SA1). The unit modifier 24 obtains a voice unit PB by adjusting the pitch of the voice unit PA selected by the unit selector 22 to a pitch DA specified by the synthesis information D (SA2). The envelope generator 30 generates a statistical spectral envelope Y in accordance with the synthesis information D using the statistical model M (SB). The order of the acquisition of the voice units PB by the unit acquirer 20 (SA) and the generation of the statistical spectral envelope Y by the envelope generator 30 (SB) is not restricted. The voice units PB may be acquired (SA) after the statistical spectral envelope Y is generated (SB).

The voice synthesizer 40 generates an audio signal V of a synthesis voice in accordance with the voice units PB acquired by the unit acquirer 20 and the statistical spectral envelope Y generated by the envelope generator 30 (SC). More specifically, by performing the characteristic-adjustment processing SC1 already shown as concerned to FIG. 4, the characteristic adjuster 42 obtains frequency spectra QC, wherein the frequency spectra QC are obtained by modifying frequency spectra QB of the voice units PB acquired by the unit acquirer 20 such that the envelopes (unit spectral envelopes X) of the frequency spectra QB approach the statistical spectral envelope Y. The unit connector 44 concatenates the voice units PC adjusted by the characteristic adjuster 42, to generate an audio signal V (SC2). The audio signal V generated by the voice synthesizer 40 (unit connector 44) is supplied to the sound output device 18.

Until the processing reaches a time point at which the voice synthesis processing S is instructed to be terminated (SD: NO), acquisition of voice units PB (SA), generation of a statistical spectral envelope Y (SB), and generation of an audio signal V (SC) are repeated. For example, in a case where an instruction to end the voice synthesis processing S is input by a user via an operation on the input device 16, or in a case where voice synthesis is completed for the entire piece of music A (SD: YES), the voice synthesis processing S ends.

As described above, in the first embodiment, an audio signal V of a synthesis voice is generated, wherein the synthesis voice is obtained by concatenating the voice units PB, and by adjusting the voice units PB in accordance with the statistical spectral envelope Y generated using the statistical model M. In this way, a synthesis voice somewhat close to a voice of the second voice feature can be generated. Accordingly, compared to a configuration where voice units PA are prepared for each voice feature, a storage capacity of the storage device 14 required for generating a synthesis voice of a desired voice feature can be reduced. Further, compared to a configuration where a synthesis voice is generated using the statistical model M, there are used voice units PA with a high time resolution and/or a high frequency resolution, and thus a high-grade synthesis voice can be generated.

In the first embodiment, an interpolated spectral envelope Z is obtained by interpolation between a unit spectral envelope X (original or before-modification frequency spectrum) of a voice unit PB and the statistical spectral envelope Y based on a variable coefficient $\alpha$. Then, the frequency spectrum QB of the voice unit PB is processed such that the envelope of the frequency spectrum QB becomes the interpolated spectrum Z. In the above-mentioned configuration, the variable coefficient (weight) a is used for controlling the interpolation between the unit spectral envelope X and the statistical spectral envelope Y. Accordingly, it is possible to control a degree to which the frequency spectra QB of voice units PB approach the statistical spectral envelope Y (a degree of adjustment of a voice feature).

In the first embodiment, the unit spectral envelope X (original or before-modification frequency spectral envelope) contains the smoothed component X1 that has a slow temporal fluctuation, and the fluctuation component X2 that fluctuates more finely as compared to the smoothed component X1. The characteristic adjuster 42 calculates an interpolated spectral envelope Z by adding the fluctuation component X2 to a spectral envelope obtained by interpolating between the statistical spectral envelope Y and the smoothed component X1. In the above embodiment, since the interpolated spectral envelope Z is calculated by adding the fluctuation component X2 to a smooth spectral envelope acquired by the above-mentioned interpolation, it is possible to calculate the interpolated spectral envelope Z on which the fluctuation component X2 is properly reflected.

The smoothed component X1 of the unit spectral envelope X is expressed by line spectral pair coefficients. The fluctuation component X2 of the unit spectral envelope X is expressed by an amplitude value for each frequency. The statistical spectral envelope Y is expressed by a low-order cepstral coefficient. In the above-mentioned embodiment, since the unit spectral envelope X and the statistical spectral envelope Y are expressed by different kinds of feature amounts, an advantage is obtained in that it is possible to use a feature amount appropriate for each of the unit spectral envelope X and the statistical spectral envelope Y. For example, in a configuration where the statistical spectral envelope Y is expressed by line spectral pair coefficients, in the process of generating the statistical spectral envelope Y using the statistical model M, there may arise a case wherein a relationship in which the coefficient values increase in order from the low order side to the high order side of the line spectral pair coefficients breaks down. In view of the above circumstances, a configuration where the statistical spectral envelope Y is expressed by a low-order cepstral coefficient is particularly preferable.

Second Embodiment

A second embodiment will now be described. In each of the modes set out below as examples, like reference signs as used in the first embodiment are used for elements whose effects or functions are substantially the same as those of the first embodiment, and detailed description of such elements is omitted, as appropriate.

Figure 6:
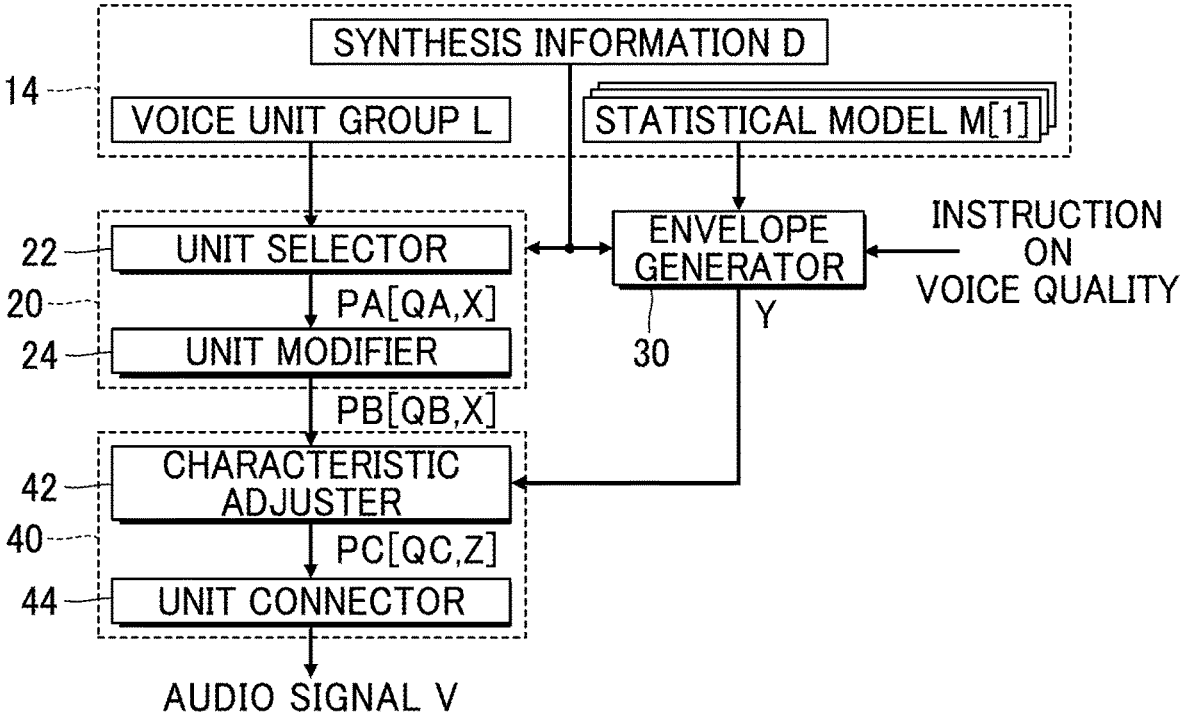
FIG. 6 is a functional block diagram of a voice synthesis apparatus according to a second embodiment.

FIG. 6 is a block diagram focusing on functions of a voice synthesis apparatus 100 of the second embodiment. As shown in FIG. 6, the storage device 14 of the voice synthesis apparatus 100 of the second embodiment stores, in addition to a voice unit group L and synthesis information D similar to those in the first embodiment, multiple (K) statistical models M[1] to M[K] corresponding to different second voice features of a speaker B. For example, the storage device 14 stores the statistical models M[1] to M[K] including a statistical model of a voice uttered forcefully, that of a voice uttered gently, that of a voice uttered vigorously, and that of a voice uttered less clearly by the speaker B. One freely chosen k-th statistical model M[k] (k=1 to K) is built in advance by machine learning in which a voice of a k-th second voice feature out of the K different kinds of second voice features uttered by the speaker B is used as training data. Accordingly, a statistical spectral envelope Y of a voice of the k-th second voice feature, among the K kinds of second voice features, is estimated by the k-th statistical model M[k]. A total data amount of the K statistical models M[1] to M[K] is smaller than a data amount of the voice unit group L.

An envelope generator 30 in the second embodiment generates a statistical spectral envelope Y by selectively using any of the K statistical models M[1] to M[K] stored in the storage device 14. For example, the envelope generator 30 generates a statistical spectral envelope Y using a statistical model M[k] that has a second voice feature and is selected by a user via an operation at the input device 16.

The manner of operation by which the envelope generator 30 generates a statistical spectral envelope Y using the statistical model M[k] is similar to that in the first embodiment. Further, in a manner similar to the first embodiment, the unit acquirer 20 acquires voice units PB in accordance with the synthesis information D, and the voice synthesizer 40 generates an audio signal V in accordance with the voice units PB acquired by the unit acquirer 20 and the statistical spectral envelope Y generated by the envelope generator 30.

In the second embodiment, advantageous effects similar to those in the first embodiment are achieved. Further, in the second embodiment, any of the K statistical models M[1] to M[K] may be selectively used for generating a statistical spectral envelope Y. Accordingly, compared to a configuration where a single statistical model M alone is used, an advantage is obtained in that synthesis voices of a variety of voice features can be generated. In the second embodiment, in particular, a k-th statistical model M[k] of a second voice feature is selected by a user via a user operation at the input device 16, and used for generating a statistical spectral envelope Y. Accordingly, an advantage is also obtained in that a synthesis voice of a voice feature that satisfies the intention or preference of the user can be generated.

Modification

Each of the above-described embodiments shown as examples can be modified in various manners. Specific forms of modification are described below as examples. Two or more forms freely selected from the following examples may be combined as appropriate.

(1) In each of the embodiments described above, the frequency spectrum QB of each voice unit PB is caused to approximate the statistical spectral envelope Y, and thereafter, the voice units PB are concatenated in the time domain. However, a configuration and a method for generating an audio signal V in accordance with the voice units PB and the statistical spectral envelope Y are not limited to the examples described above.

Figure 7:
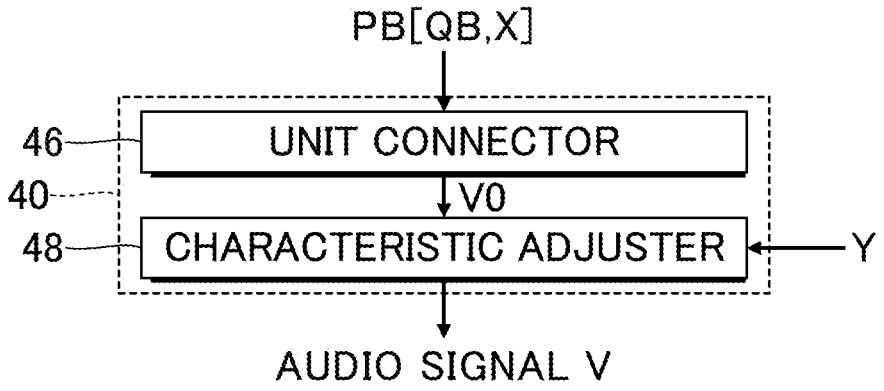
FIG. 7 is a block diagram of a voice synthesizer according to a modification.

For example, a voice synthesizer 40 may have a configuration shown in FIG. 7. The voice synthesizer 40 shown in FIG. 7 includes a unit connector 46 and a characteristic adjuster 48. The unit connector 46 concatenates voice units PB acquired by the unit acquirer 20 to generate an audio signal V0. More specifically, the unit connector 46 transforms a frequency spectrum QB of each frame in voice units PB into a signal in the time domain, and aligns signals of adjacent frames to partially overlap each other on the time axis, and adds the aligned signals, thereby generating an audio signal V0 that corresponds to a series of frames. The audio signal V0 is in the time domain and represents synthesis voice of the first voice feature. The characteristic adjuster 48 in FIG. 7 applies frequency characteristics of the statistical spectral envelope Y to the audio signal V0 in the time domain to generate an audio signal V. The characteristic adjuster 48 may be a filter of a frequency response which is set in accordance with a frequency spectral envelope of a difference between the statistical spectral envelope Y and the smoothed component X1. The embodiment with the voice synthesizer 40 in FIG. 7, similarly to the above-mentioned embodiments, generates an audio signal V of a synthesis voice of a second voice feature.

Figure 8:
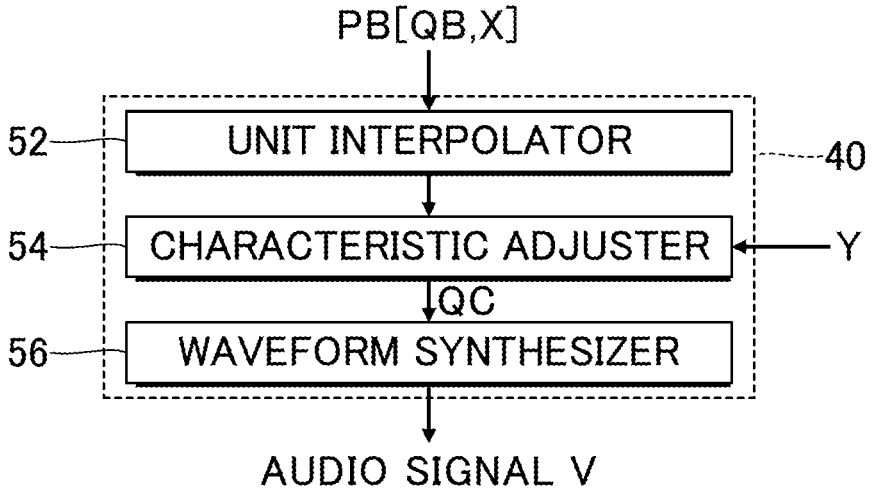
FIG. 8 is a block diagram of a voice synthesizer according to a modification.

Alternatively, a voice synthesizer 40 may have a configuration shown in FIG. 8. The voice synthesizer 40 shown in FIG. 8 includes a unit interpolator 52, a characteristic adjuster 54, and a waveform synthesizer 56. The unit interpolator 52 performs interpolation processing on the voice units PB acquired by the unit acquirer 20. More specifically, interpolation processing of frequency spectra QB and interpolation processing of unit spectral envelopes X are performed in the frequency domain between adjacent voice units PB. The interpolation processing of the frequency spectra QB is to perform interpolation (e.g., cross-fading) of the frequency spectra QB between two voice units PB adjacent to each other in time such that the frequency spectra change from the preceding unit to the succeeding unit smoothly at the connecting portion between the two voice units. The interpolation processing of the unit spectral envelopes X is to perform interpolation (e.g., cross-fading) of the frequency spectra of the smoothed components X1 and interpolation (e.g., cross-fading) of the spectra of the fluctuation components X2 between two adjacent voice units PB such that the spectral envelopes change from the preceding unit to the succeeding unit smoothly at the connecting portion between the two voice units. In other words, the unit interpolator 52 performs processing for concatenating each pair of adjacent voice units PB in the frequency domain.

The characteristic adjuster 54 shown in FIG. 8 obtains frequency spectra QC by adjusting each of the frequency spectra, on which the interpolation processing has been performed by the unit interpolator 52, to approach the statistical spectral envelope Y. In obtaining frequency spectra QC by the characteristic adjuster 54, the characteristic-adjustment processing SC1 described above with reference to FIG. 4 may be used. The waveform synthesizer 56 shown in FIG. 8 generates an audio signal V in the time domain from a time series of the frequency spectra QC generated by the characteristic adjuster 54.

As will be understood from the above examples, the voice synthesizer 40 is merely an example of an element that generates an audio signal V of a synthesis voice obtained by concatenating voice units PB acquired by the unit acquirer 20, and in which synthesis voice the voice units PB are adjusted in accordance with the statistical spectral envelope Y. The voice synthesizer 40 is merely an example of an element that concatenates voice units PB sequentially acquired by the unit acquirer 20; modifies a frequency spectral envelope (unit spectral envelope X) of each voice unit PB in accordance with the statistical spectral envelope Y; and synthesizes a voice signal based on the concatenated voice units having the modified frequency spectra. In other words, the voice synthesizer 40 may be any of [A] to [C] below, for example.

[A] An element that adjusts voice units PB in accordance with the statistical spectral envelope Y, and then, concatenates the adjusted voice units PC in the time domain (FIG. 3).

[B] An element that concatenate voice units PB in the time domain, and then, applies frequency characteristics in accordance with the statistical spectral envelope Y (FIG. 7).

[C] An element that concatenate (specifically, interpolates) voice units PB in the frequency domain and adjusts the concatenated voice units PB in accordance with the statistical spectral envelope Y, and then, transforms the voice units PB into a signal in the time domain (FIG. 8).

For example, as in the case of [A], voice units PB may be adjusted in accordance with the statistical spectral envelope Y in the frequency domain, and then, may be concatenated in the time domain. Alternatively, as in the case of [B], voice units PB may be concatenated in the time domain before the frequency characteristics in accordance with the statistical spectral envelope Y are applied in the time domain. Alternatively, as in the case of [C], voice units PB may be concatenated (interpolated) in the frequency domain before being adjusted in accordance with the statistical spectral envelope Y in the frequency domain.

For example, as in the case of [A], the frequency spectral envelope of each of the voice units PB may be modified before the voice units PB are concatenated in the time domain. Alternatively, as in the case of [B], the voice units PB may be concatenated in the time domain and frequency characteristics in accordance with the statistical spectral envelope Y may be applied to the concatenated voice units PB in the time domain, as a result of which the frequency spectral envelope is caused to be modified. Alternatively, as in the case of [C], the frequency spectral envelope may be modified after the voice units PB are concatenated (interpolated) in the frequency domain.

(2) In each of the embodiments described above, an exemplary case is shown in which the speaker of the voice units PA and the speaker of a voice to be used in performing learning for the statistical model M are the same speaker B. However, as the voice to be used in performing learning for the statistical model M, the voice of a speaker E different from the speaker B of the voice units PA may be used. Further, in the above-mentioned embodiments, the statistical model M is built by machine learning that uses the voice of the speaker B as training data. However, the statistical model M may be built in a way different from the example described above. For example, the statistical model M of the speaker B may be built by adaptively correcting a statistical model of the speaker B that is built by using a small amount of training data of the speaker B, wherein the correction being made based on a statistical model of the speaker E, who is different from the speaker B, that is built in advance by machine learning in which spectral envelopes of the voice of the speaker E are used as training data.

(3) In each of the embodiments described above, the statistical model M is built by machine learning in which spectral envelopes of the voice of the speaker B classified for each attribute are used as training data. However, a statistical spectral envelope Y may be generated by a method other than the method that uses the statistical model M. For example, it may be also possible to adopt a configuration (hereafter referred to as "modified configuration") where statistical spectral envelopes Y that correspond to different attributes are stored in the storage device 14 in advance. For example, a statistical spectral envelope Y corresponding to one freely chosen attribute is an average of spectral envelopes of voices classified into the attribute from among the voices of a certain voice feature uttered by the speaker B. The envelope generator 30 sequentially selects statistical spectral envelopes Y of an attribute in accordance with the synthesis information D from the storage device 14, and similarly to the first embodiment, the voice synthesizer 40 generates an audio signal V in accordance with the statistical spectral envelopes Y and the voice units PB. According to the modified configuration, it is unnecessary to generate a statistical spectral envelope Y using the statistical model M. In the modified configuration, since spectral envelopes are averaged over multiple voices, the statistical spectral envelope Y may have characteristics smoothed along the time-axis direction and the frequency-axis direction. Compared to the modified configuration, in each of the above-mentioned embodiments where the statistical spectral envelope Y is generated by using the statistical model M, an advantage is obtained in that it is possible to generate a statistical spectral envelope Y that maintains a fine structure along the time-axis direction and the frequency-axis direction (i.e., smoothing is suppressed).

(4) In each of the embodiments described above, an exemplary configuration is shown where the synthesis information D specifies a pitch DA and one or more phonemes DB for each musical note. However, the contents of the synthesis information D are not limited to the examples described above. For example, in addition to the pitch DA and the phonemes DB, one or more volumes (dynamics) may be specified by the synthesis information D. The unit modifier 24 adjusts the volume of a voice unit PA selected by the unit selector 22 to a volume specified by the synthesis information D. Alternatively, voice units PA that have the same phoneme but have different volumes may be recorded in the voice unit group L, and the unit selector 22 may select a voice unit PA having a volume close to the volume specified by the synthesis information D from among voice units PA that correspond to the phoneme DB specified by the synthesis information D.

(5) In each of the embodiments described above, the voice units PB are adjusted in accordance with the statistical spectral envelope Y over all sections in the music piece A. Alternatively, adjustment of voice units PB using the statistical spectral envelope Y may be selectively performed on some of the sections (hereafter referred to as "adjustment sections") in the music piece A. For example, an adjustment section is a section specified in the music piece A by a user via the input device 16; or a section, in the music piece A, for which a start point and an end point are specified by the synthesis information D. The characteristic adjuster (42, 48 or 54) may apply the statistical spectral envelope Y to each voice unit PB within the adjustment sections. For sections other than the adjustment sections, an audio signal V based on the concatenated voice units PB (i.e., an audio signal V in which the statistical spectral envelope Y is not applied) is output from the voice synthesizer 40. According to the above configuration, a voice of the first voice feature is uttered outside the adjustment sections, and voice of the second voice feature is uttered in the adjustment sections. Accordingly, it is possible to generate audio signals V of various synthesis voices.

An adjustment of voice units PB using the statistical spectral envelope Y may be performed on each of different adjustment sections within the music piece A. Further, in a configuration (e.g., the second embodiment) where statistical models M[1] to M[K] that correspond to different second voice features of the speaker B are stored in the storage device 14, the adjustment of the voice units PB may be performed on each of the adjustment sections within the music piece A with using statistical models M[k] different from each other. A start point and an end point of each of the adjustment sections and the statistical model M[k] to be used for each adjustment section may be specified by the synthesis information D. According to the above-mentioned configuration, it is possible to generate an audio signal V of various synthesis voices where a voice feature (e.g., articulation of the singing voice) changes in each adjustment section.

(6) The feature amount that expresses a unit spectral envelope X or a statistical spectral envelope Y is not limited to the examples (line spectral pair coefficients or low-order cepstral coefficients) described in each of the above-mentioned embodiments. For example, the unit spectral envelope X or the statistical spectral envelope Y may be expressed by a series of amplitude values of each frequency. Alternatively, the unit spectral envelope X or the statistical spectral envelope Y may be expressed by EpR (Excitation plus Resonance) parameters that approximate vibration characteristics of vocal cords and resonance characteristics of an articulatory organ. The EpR parameters are disclosed in Japanese Patent No. 3711880, or Japanese Patent Application Laid-Open Publication No. 2007-226174, for example. Alternatively, the unit spectral envelope X or the statistical spectral envelope Y may be expressed by a weighted sum of normal distributions (i.e., a Gaussian mixture model).

(7) The voice synthesis apparatus 100 may be a server device that communicates with a terminal device (e.g., a mobile phone or a smartphone) via a mobile communication network or a communication network, such as the Internet. For example, the voice synthesis apparatus 100 generates an audio signal V via the voice synthesis processing S that uses the synthesis information D received from the terminal device, and transmits the generated audio signal V to a terminal device that made the request.

(8) As mentioned above, the exemplary voice synthesis apparatus 100 described in each of the above-mentioned embodiments is realized by cooperation of the control device 12 and the program. The exemplary program described in each of the above-mentioned embodiments causes a computer (e.g., the control device 12) to function as the unit acquirer 20, the envelope generator 30, and the voice synthesizer 40. The unit acquirer 20 sequentially acquires voice units PB in accordance with the synthesis information D by which contents to be synthesized are instructed. The envelope generator 30 generates a statistical spectral envelope Y in accordance with the synthesis information D using the statistical model M. The voice synthesizer 40 generates an audio signal V of a synthesis voice obtained by concatenating the voice units PB acquired by the unit acquirer 20, and in which synthesis voice the voice units PB are adjusted in accordance with the statistical spectral envelope Y generated by the envelope generator 30.

The exemplary program described above may be stored in a computer-readable recording medium, and may be installed in a computer system. The recording medium may be a non-transitory recording medium, for example, an optical recording medium (optical disk), such as a CD-ROM. However, the recording medium may be any type of media, such as a semiconductor recording medium or a magnetic recording medium. The "non-transitory recording medium" includes any recording medium other than transitory, propagating signal; and volatile recording media are not excluded. The program may be delivered to the computer via a communication network.

(9) A preferred mode may be a method (voice synthesis method) for operating the voice synthesis apparatus 100 according to each of the above-mentioned embodiments. In a voice synthesis method according to a preferred mode, a computer system (a single computer or multiple computers) sequentially acquires voice units PB in accordance with the synthesis information D by which contents to be synthesized are instructed; generates a statistical spectral envelope Y in accordance with the synthesis information D using the statistical model M; and generates an audio signal V of a synthesis voice obtained by concatenating the acquired voice units PB, and in which synthesis voice the voice units PB are adjusted in accordance with the statistical spectral envelope Y.

(10) The following configurations can be understood from the embodiments provided as examples above, for example.

First Aspect

A voice synthesis method according to a preferred aspect (aspect 1) includes: sequentially acquiring voice units in accordance with synthesis information for synthesizing voices; generating a statistical spectral envelope using a statistical model, in accordance with the synthesis information; and concatenating the acquired voice units and modifying a frequency spectral envelope of each of the acquired voice units in accordance with the generated statistical spectral envelope, thereby synthesizing a voice signal based on the concatenated voice units having the modified frequency spectra. In the above aspect, there is generated an audio signal of a synthesis voice (e.g., a synthesis voice of a voice feature close to a voice feature modeled by using the statistical model) obtained by concatenating the voice units, and in which synthesis voice the voice units are adjusted in accordance with the statistical spectral envelope generated using the statistical model. Accordingly, compared to a configuration where voice units are prepared for each voice feature, a storage capacity required for generating a synthesis voice of a desired voice feature can be reduced. Further, compared to a configuration where a synthesis voice is generated using a statistical model without using voice units, it is possible to generate a high-grade synthesis voice using voice units with a high time resolution or a high frequency resolution.

Second Aspect

In a preferred example (aspect 2) of aspect 1, the synthesizing the voice signal includes: modifying the frequency spectral envelope of each voice unit such that the frequency spectral envelope approximates the statistical spectral envelope; and concatenating the modified voice units.

Third Aspect

In a preferred example (aspect 3) of aspect 2, in modifying the frequency spectral envelope of each voice unit, interpolation is performed between the original (before-modification) frequency spectral envelope of each voice unit and the statistical spectral envelope using a variable interpolation coefficient so as to acquire an interpolated spectral envelope, and the original (before-modification) frequency spectral envelope of each voice unit is modified based on the acquired interpolated spectral envelope. In the above aspect, the interpolation coefficient (weight) used for the interpolation between the original frequency spectral envelope (unit spectral envelope) and the statistical spectral envelope, is set to vary. Accordingly, it is possible to vary a degree to which the frequency spectra of the voice units approximate the statistical spectral envelope (a degree of adjustment of a voice feature).

Fourth Aspect

In a preferred example (aspect 4) of aspect 3, each original frequency spectral envelope contains a smoothed component that has slow temporal fluctuation and a fluctuation component that fluctuates faster and more finely as compared to the smoothed component; and in modifying the frequency spectral envelope of each voice unit, the interpolated spectral envelope is calculated by adding the fluctuation component to a spectral envelope acquired by performing interpolation between the statistical spectral envelope and the smoothed component. In the above aspect, the interpolated spectral envelope is calculated by adding the fluctuation component to the result of interpolation between the statistical spectral envelope and the smoothed component of the original frequency spectral envelope (unit spectral envelope). Accordingly, it is possible to calculate an interpolated spectral envelope that appropriately contains the smoothed component and the fluctuation component.

Fifth Aspect

In a preferred example (aspect 5) of aspect 1, synthesizing the voice signal includes: concatenating the sequentially acquired voice units in a time domain; and modifying the frequency spectral envelopes of the concatenated voice units by applying, in the time domain, a frequency characteristic of the statistical spectral envelope to the voice units concatenated in the time domain.

Sixth Aspect

In a preferred example (aspect 6) of aspect 1, the synthesizing the voice signal includes: concatenating the sequentially acquired voice units by performing interpolation, in a frequency domain, between voice units adjacent to each other in time; and modifying the frequency spectral envelopes of the concatenated voice units such that the frequency spectral envelopes approximate the statistical spectral envelope.

Seventh Aspect

In a preferred example (aspect 7) of any one of aspect 1 to aspect 6, the frequency spectral envelopes and the statistical spectral envelope are expressed as different types of feature amounts. To express the frequency spectral envelopes (unit spectral envelopes), a feature amount that contains a parameter in the frequency-axis direction is preferably adopted. More specifically, the smoothed component of a unit spectral envelope is preferably expressed by feature amounts such as line spectral pair coefficients, EpR (Excitation plus Resonance) parameters, or a weighted sum of normal distributions (i.e., a Gaussian mixture model), for example; and the fluctuation component of a unit spectral envelope is expressed, for example, by feature amounts such as an amplitude value for each frequency. To express the statistical spectral envelope, feature amounts preferable for the statistical calculation are adopted, for example. More specifically, the statistical spectral envelope is expressed, for example, by feature amounts such as low-order cepstral coefficients or an amplitude value for each frequency. In the above aspect, since the frequency spectral envelope (unit spectral envelope) and the statistical spectral envelope are expressed using different types of feature amounts, an advantage is obtained in that feature amounts appropriate for each of the unit spectral envelope and the statistical spectral envelope can be used.

Eighth Aspect

In a preferred example (aspect 8) of any one of aspect 1 to aspect 7, in generating the statistical spectral envelope, the statistical spectral envelope is generated by selectively using one of the statistical models that correspond to different voice features. In the above aspect, since one of the statistical models is selectively used for generating a statistical spectral envelope, compared to a configuration where only a single statistical model alone is used, an advantage is obtained in that a synthesis voice of various voice features can be generated.

Ninth Aspect

A voice synthesis apparatus according to a preferred aspect (aspect 9) includes: a unit acquirer configured to sequentially acquire voice units in accordance with synthesis information for synthesizing voices; an envelope generator configured to generate a statistical spectral envelope using a statistical model in accordance with the synthesis information; and a voice synthesizer configured to concatenate the acquired voice units and modify a frequency spectral envelope of each of the acquired voice units in accordance with the generated statistical spectral envelope, thereby synthesizing a voice signal based on the concatenated voice units having the modified frequency spectra.

DESCRIPTION OF REFERENCE SIGNS

100 . . . voice synthesis apparatus; 12 . . . control device; 14 . . . storage device; 16 . . . input device; 18 . . . sound output device; 20 . . . unit acquirer; 22 . . . unit selector; 24 . . . unit modifier; 30 . . . envelope generator; 40 . . . voice synthesizer; 42, 48, 54 . . . characteristic adjuster; 44, 46 . . . unit connector; L . . . voice unit group; D . . . synthesis information; M . . . statistical model.

What is claimed is:

1. A voice synthesis method comprising:

sequentially acquiring voice units comprising at least one of a diphone or a triphone in accordance with synthesis information for synthesizing voices, each voice unit specifying a frequency spectrum for each of unit temporal periods;

generating a statistical spectral envelope of each unit temporal period using a statistical model built by machine learning in advance, in accordance with the synthesis information, the statistical model being trained to estimate a spectral envelope;

modifying a frequency spectral envelope, including a frequency spectrum thereof, of each unit temporal period of each of the sequentially acquired voice units in accordance with the generated statistical spectral envelope of the respective unit temporal period to synthesize a voice signal having modified frequency spectra; and concatenating the sequentially acquired voice units before the modifying or the modified acquired voice units after the modifying.

2. The voice synthesis method according to claim 1, wherein:

the modifying modifies the frequency spectral envelope of each acquired voice unit to approximate the respective generated statistical spectral envelope, and the concatenating concatenates the modified voice units.

3. The voice synthesis method according to claim 2, wherein the modifying:

performs interpolation between an original frequency spectral envelope of each voice unit and the respective generated statistical spectral envelope using a variable interpolation coefficient to acquire an interpolated spectral envelope, and modifies the original frequency spectral envelope of each voice unit based on the interpolated spectral envelope.

4. The voice synthesis method according to claim 3, wherein:

each original frequency spectral envelope contains a smoothed component that has slow temporal fluctuation and a fluctuation component that fluctuates faster and more finely as compared to the smoothed component, and the modifying calculates the interpolated spectral envelope by adding the fluctuation component to a spectral envelope acquired by performing interpolation between the statistical spectral envelope and the smoothed component.

5. The voice synthesis method according to claim 1, wherein the statistical model includes transition models each of which is specified by an attribute to be identified in the synthesis information, which is generated and modified in accordance with instructions input by a user.

6. The voice synthesis method according to claim 5, wherein the attribute to be identified represents a context corresponds to at least one of pitch, volume, or phoneme.

7. The voice synthesis method according to claim 1, wherein:

the concatenating concatenates the sequentially acquired voice units in a time domain, and the modifying modifies the frequency spectral envelopes of the concatenated voice units by applying, in the time domain, a frequency characteristic of the respective generated statistical spectral envelopes to the voice units concatenated in the time domain.

8. The voice synthesis method according to claim 1, wherein:

the concatenating concatenates the sequentially acquired voice units by performing interpolation, in a frequency domain, between voice units in the frequency domain adjacent to each other in time, and the modifying modifies the frequency spectral envelopes of the concatenated voice units to approximate the respective generated statistical spectral envelopes.

9. The voice synthesis method according to claim 1, wherein the frequency spectral envelopes and the respective generated statistical spectral envelopes are expressed as different types of feature amounts.

10. The voice synthesis method according to claim 1, wherein the generating selects the statistical model from among a plurality of statistical models that correspond to different voice features.

11. The voice synthesis method according to claim 1, wherein:

the modifying modifies the frequency spectral envelope of each acquired voice unit to approximate the respective generated statistical spectral envelope in a frequency domain, and the concatenating concatenates the modified voice units by performing interpolation, in a time domain, between acquired voice units adjacent to each other in time.

12. The voice synthesis method according to claim 1, wherein the estimated spectral envelope is of a voice feature corresponding to one of a voice uttered more forcefully, a voice uttered more gently, a voice uttered more vigorously, or a voice uttered less clearly than another voice feature of the voice units.

13. A voice synthesis apparatus comprising:

a memory storing instructions; and one or more processors that implement the instructions to:

sequentially acquire voice units comprising at least one of a diphone or a triphone in accordance with synthesis information for synthesizing voices, each voice unit specifying a frequency spectrum for each of unit temporal periods;

generate a statistical spectral envelope of each unit temporal period using a statistical model that is built by machine learning in advance, in accordance with the synthesis information, the statistical model being trained to estimate a spectral envelope;

modify a frequency spectral envelope of, including a frequency spectrum thereof, of each unit temporal period of each of the sequentially acquired voice units in accordance with the generated statistical spectral envelope of the respective unit temporal period to synthesize a voice signal having modified frequency spectra; and concatenate the sequentially acquired voice units before the modifying or the modified acquired voice units after the modifying.

14. A non-transitory computer-readable storage medium storing a program executable by a computer to execute a voice synthesis method comprising:

sequentially acquiring voice units comprising at least one of a diphone or a triphone in accordance with synthesis information for synthesizing voices, each voice unit specifying a frequency spectrum for each of unit temporal periods;

generating a statistical spectral envelope of each unit temporal period using a statistical model that is built by machine learning in advance, in accordance with the synthesis information, the statistical model being trained to estimate a spectral envelope;

modifying a frequency spectral envelope, including a frequency spectrum thereof, of each unit temporal period of each of the sequentially acquired voice units in accordance with the generated statistical spectral envelope of the respective unit temporal period to synthesize a voice signal having modified frequency spectra; and concatenating the sequentially acquired voice units before the modifying or the modified acquired voice units after the modifying.

* * * * *